United States Patent [19]

Fogg

[11] 4,161,922

[45] Jul. 24, 1979

[54] ANCHOR CADDY

[75] Inventor: Francis Fogg, Scotia, N.Y.

[73] Assignee: Fish-N-Mate Ltd., Gloversville, N.Y.

[21] Appl. No.: 882,402

[22] Filed: Mar. 1, 1978

[51] Int. Cl.[2] ..... B63B 21/22

[52] U.S. Cl. ..... 114/297; 114/299

[58] Field of Search ..... 114/51, 221 R, 297, 114/294, 299, 311, 234, 293; 9/8 R

[56] References Cited

U.S. PATENT DOCUMENTS

| | | | |
|---|---|---|---|
| 3,913,514 | 10/1975 | Reynolds | 114/297 |
| 3,922,990 | 12/1975 | Menard | 114/221 R |
| 4,067,287 | 1/1978 | Sabella | 114/299 |

*Primary Examiner*—Trygve M. Blix
*Assistant Examiner*—James B. Bechtel
*Attorney, Agent, or Firm*—LeBlanc & Shur

[57] ABSTRACT

An anchor caddy useful in raising an anchor by translating the force exerted on the anchor line by movement of the boat to a vertical force on the anchor is disclosed. The device can also function having the anchor on a few feet of line extending therefrom, as a sea anchor. The anchor caddy consists of a float adapted to support the anchor and caddy. A pulley and housing therefore are attached to the float and movable deflector plates are pivotally mounted at ends thereof on either side of the pulley housing. The anchor line extends from the anchor, over the pulley, through a releaseable, one way dogging mechanism, mounted within the housing, to the boat. The dogging mechanism, when engaged, will permit the line to pass over the pulley only in the direction of the boat. Force exerted on the line causes the deflector plates to pivot outwardly to about 45° angles with the pulley. The plates then create sufficient drag to keep the caddy relatively in place on the water surface so that as the line is pulled a vertical force will be exerted to raise the anchor.

10 Claims, 7 Drawing Figures

ANCHOR CADDY

This invention relates to a device for use in retrieving an anchor, and in particular to a versatile flotation device which will achieve retrieval to the water surface solely by movement of the boat. In addition, the device may be adapted to use with the anchor as a sea anchor to restrict drift as when trolling or casting with drift. Furthermore, the device may be used to retrieve the anchor, tow it to another spot and set the anchor without the necessity of loading the anchor on board.

The prior art contains different types of flotation devices intended to be used to assist in retrieving a boat anchor. Such devices are described, for example, in U.S. Pat. Nos. 3,094,095; 3,913,514; and 3,922,990. These devices are intended to utilize the boat to raise an anchor without appreciably dragging the anchor along the ocean bottom whereby it could become fouled or wedged between rocks. These prior art devices are directed to utilizing a float member to exert a vertical force on the anchor whereby movement of the boat will raise the anchor without dragging it.

However, certain of these devices require that the boat must be traveling in a specific direction relative to the anchor in order to pick the anchor up. In others, the float member is not intended to remain at the surface of the water and as the movement of the boat causes the float to sink, a lateral drag is exerted upon the anchor. None of the devices are sufficiently versatile to function as a marker buoy for the anchor, a sea anchor, and permit towing of a retrieved anchor to another site where it automatically sinks to be reset.

It has been discovered that a superior anchor caddy may be constructed according to this invention which will exert sufficient drag forces while an anchor is retrieved to be maintained at or near the water surface so that a nearly vertical pull is exerted on the anchor. It has further been discovered that a versatile anchor caddy can be constructed according to this invention by providing a one way dogging mechanism therein which may be readily released with one hand or from a remote location to permit the anchor line to pass through the device in one direction only, or in the alternative, to permit free passage of the line through the device either toward the anchor, or toward the boat.

The device of this invention includes a float member and a dogging mechanism mounted thereon. The float member is sufficiently buoyant to support both the dogging mechanism and the anchor and line. The dogging mechanism comprises a pulley mounted within a housing. A spring biased pawl is provided adjacent the pulley track for normally permitting the anchor line to freely pass over the pulley only in the direction of the boat. The dogging mechanism is attached to the float by a tube which extends therethrough. A latching mechanism extends through the tube from the biased pawl to the opposite end thereof so that if desired, the pawl may be disengaged to allow free passage of the line across the pulley.

A hydraulic braking mechanism is mounted on the pulley housing which, as noted above, is mounted to depend from the float. The braking mechanism comprises opposed, pivotally mounted plates which are attached on either side of the pulley. The plates are pivotally mounted at the upper portion of the housing adjacent the float so that the plates normally extend downwardly from the pivotal mounting along the sides of the pulley. When the anchor line is drawn across the pulley in the direction of the float, the plates will automatically pivot outwardly to form approximately 45° angles with the pulley housing. The plates then exert a drag force against movement in the direction the line is being drawn and thereby the drag forces exerted by the float and the plates maintain the caddy at or near the water surface as the anchor is drawn in. When the anchor line slackens, the pulley housing will rotate to a position depending from the float and the plates will automatically pivot from positions at an angle to the housing to positions parallel to the housing.

Accordingly, the drag forces will be exerted until the anchor is drawn from the bottom to the caddy. Further movement of the boat then will tow both the anchor and the caddy. As the boat is propelled in the direction of the caddy and the anchor retrieved, the dogging mechanism will engage the anchor line, normally. If it is desired to set the anchor, the dogging mechanism may simply be released from above at the latching mechanism whereupon the anchor will sink.

In the alternative, the dogging mechanism may be released before the anchor is retrieved, and the anchor and caddy towed to a desired location whereupon slackening of the anchor line will automatically release the anchor to sink to the bottom. The dogging mechanism may then be engaged and the anchor caddy float will serve as a marker buoy.

In the alternative, a sea anchor may be formed by utilizing the anchor caddy of this invention with the anchor on a few feet of line extending from the caddy and with the dogging mechanism engaged. The drag exerted will then restrict drift of the boat while trolling or casting.

Accordingly, it is an object of this invention to provide a versatile device useful to raise an anchor solely by movement of the boat without dragging the anchor on the bottom.

It is another object to provide an anchor caddy having sufficient hydraulic drag to be maintained at or near the surface of the water as an anchor line is drawn therethrough to raise an anchor from the bottom.

It is another object to provide an anchor caddy device having drag plates which will automatically extend when an anchor line is taut, but will retract when the line slackens, whereby an anchor may be rapidly and efficiently retrieved solely by movement of the boat.

It is still another object to provide an anchor caddy device which will alternatively permit one way passage of an anchor line therethrough or free passage by activating or releasing a dogging mechanism which may be latched or unlatched from an activating means on the upper surface of the associated float member.

These and other objects will become readily apparent with reference to the drawings and following description wherein.

Figure 1:
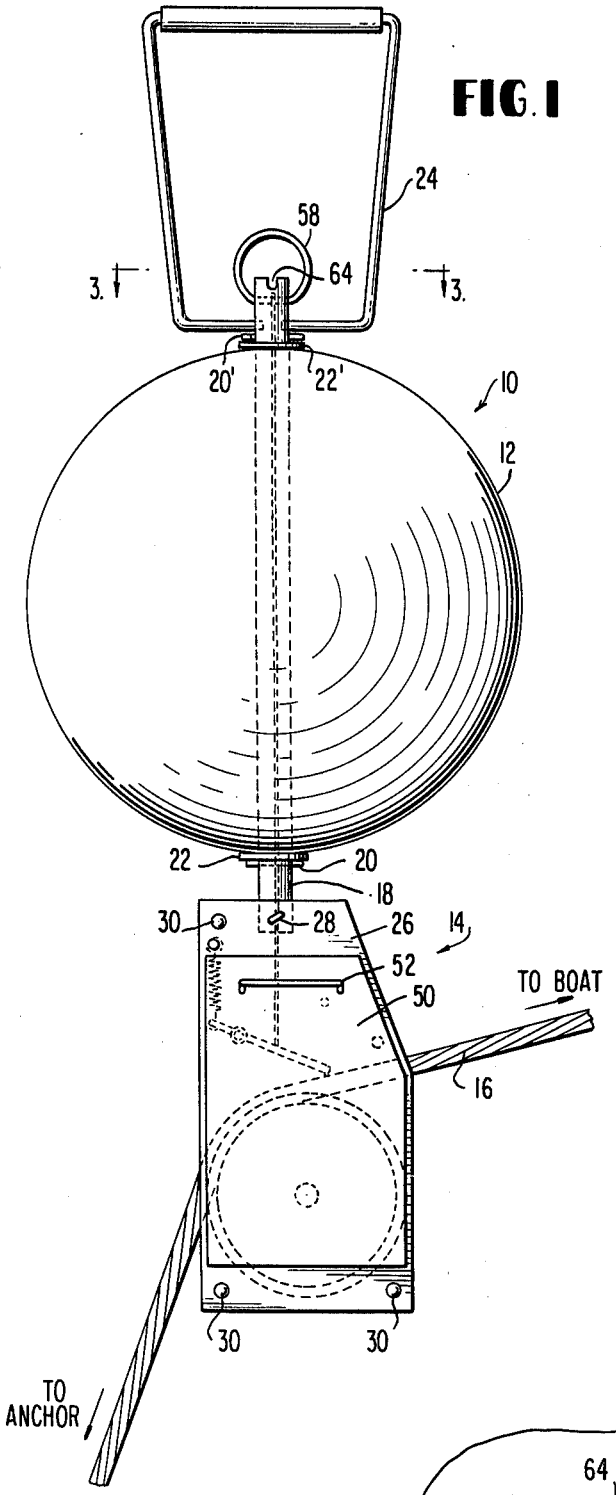
FIG. 1 is a side view of the device of this invention.
Figure 2:
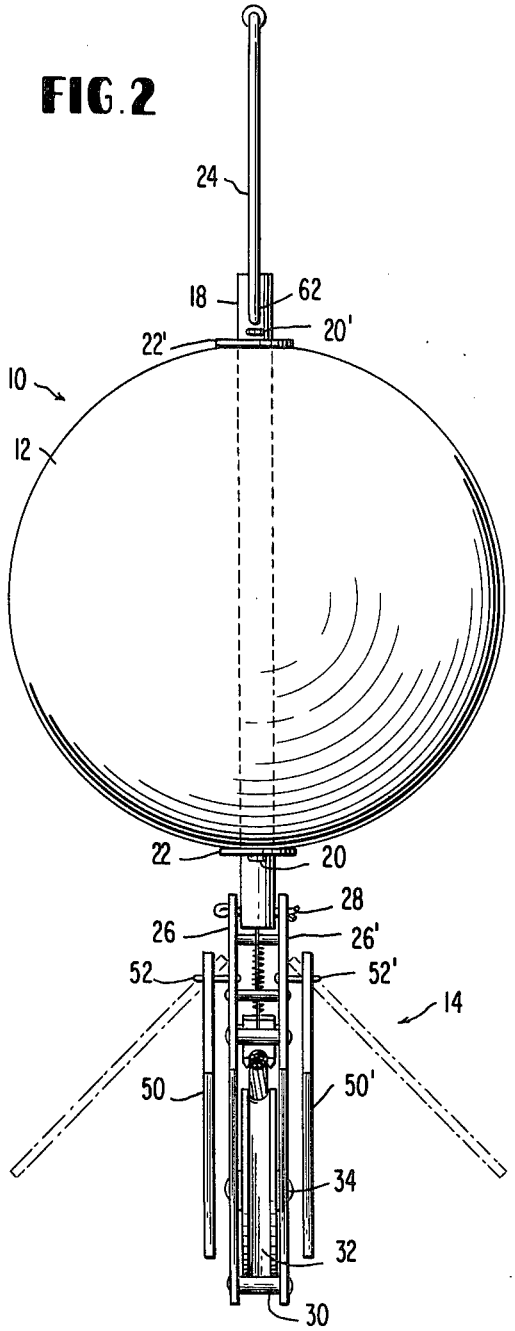
FIG. 2 is a front view of the device of this invention showing the deflector plates in phantom in an extended position.
Figure 6:
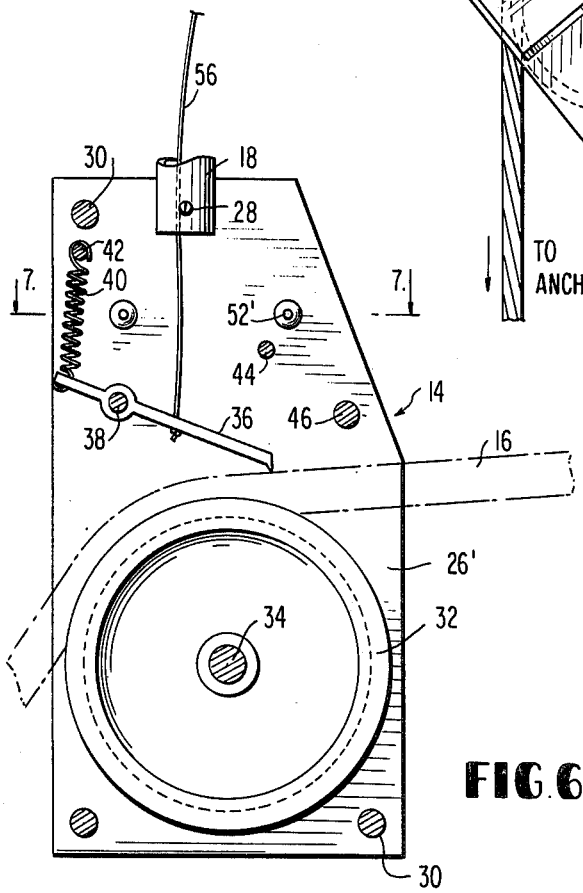
FIG. 6 is a fragmentary view of the dogging mechanism of the device of this invention having one side removed.

With attention to the drawings and to FIGS. 1, 2 and 6, in particular, the anchor caddy device of this invention 10 includes a float member 12 and a dogging assembly 14. The float 12 may be a sphere as shown herein, or, as would be obvious to one skilled in the art, may be of any shape. In the preferred embodiment, the float is approximately 10 inches in diameter and is constructed of conventional material. It is essential however that the float be of sufficient buoyancy to lift both the anchor (not shown), the anchor line 16, and the dogging mechanism 14.

Mechanism 14 is mounted on one end of an attaching tube 18. Tube 18 extends axially through float 12. Tube 18 is positioned relative to float 12 by, preferably, pins 20 and 20' and washers 22 and 22'. A carrying handle 24 is pivotally mounted in holes at the end of tube 18 opposite the mechanism 14.

The dogging mechanism 14 comprises a pair of flat plates 26 and 26' attached at an end thereof to the tube 18 by for example a pin 28. Plates 26 and 26' are equidistantly spaced and are held together by spacer pins 30.

A pulley 32 is rotatably mounted between plates 26 and 26' by an axial pin 34 extending therethrough. One way dogging action is provided by pawl 36 mounted by bearing pin 38 between plates 26 and 26'. Pawl 36 is biased by a spring 40 which extends therefrom to a catch pin 42. The upward travel or rotation of pawl 36 about pin 38 is limited by a pin stop 44 which extends between plates 26 and 26'. A second pin stop 46 is also provided to prevent the anchor line 16 from fouling.

Figure 7:
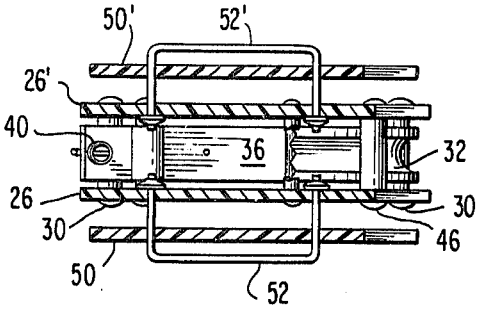
FIG. 7 is a cross-sectional view taken along line 7—7 of FIG. 6.

With attention to FIG. 7, deflector plates 50 and 50' are pivotally mounted at an end thereof to plates 26 and 26' by retaining wires 52 and 52'.

Figure 3:
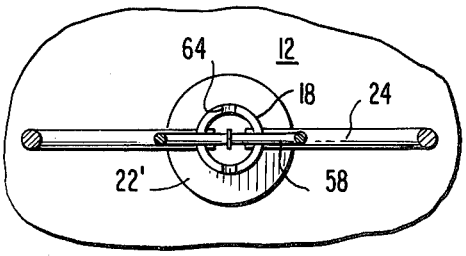
FIG. 3 is a fragmentary view taken along line 3—3 of FIG. 1.
Figure 4:
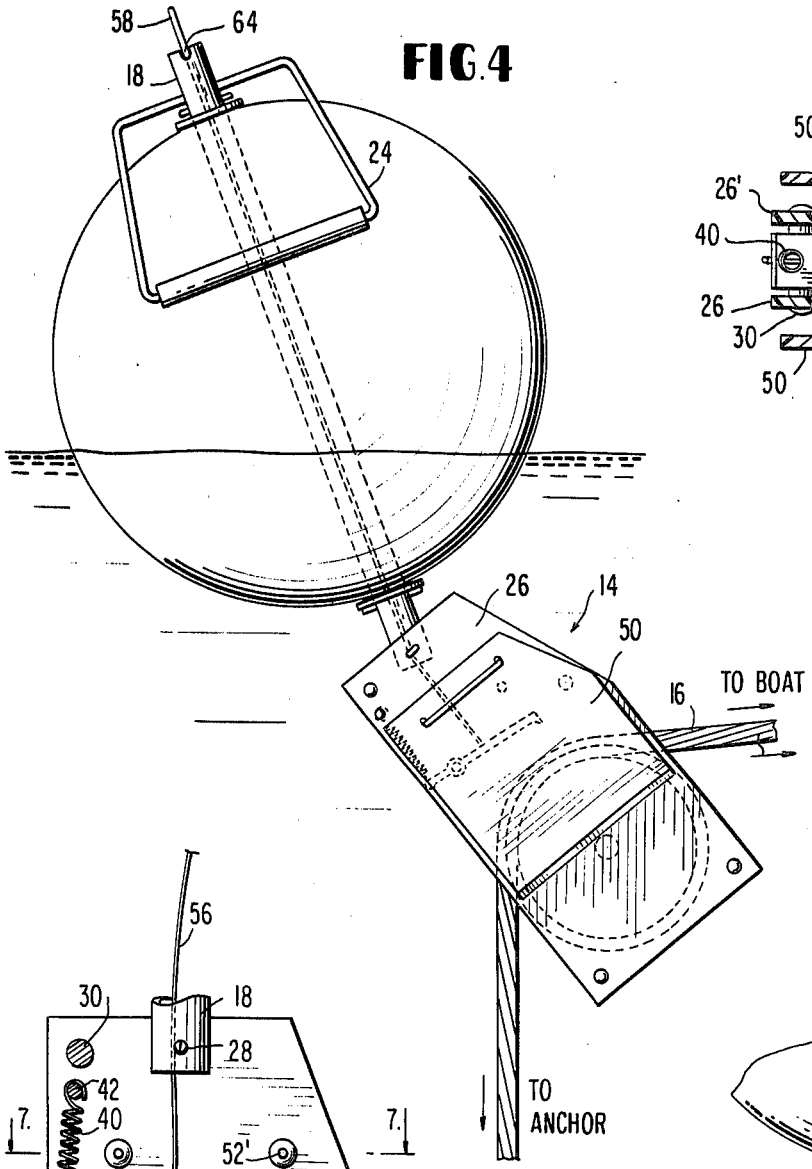
FIG. 4 is a view of the device of this invention during retrieval of an anchor.

With attention to FIGS. 1, 3 and 6, pawl 36 is engaged or disengaged by a latching mechanism which includes a release cable 56 which extends from pawl 36, through tube 18, to a D-ring 58. As shown in FIGS. 1 and 2, when D-ring 58 rests in a deep slot 62 in the upper end of tube 18, cable 56 allows pawl 36 to normally engage the anchor line 16 against pulley 32. In this position then, the dogging mechanism will permit only one way travel of the line 16 toward the boat. However, a second slot 64 disposed at right angles to slot 62 is sufficiently shallow to disengage pawl 36 when ring 58 rests therein. As shown in FIG. 4, when ring 58 rests in slot 64, the release cable 56 will not permit the pawl 36 to engage the line 16. The line is therefore free to travel across pulley 32 in either the direction of the anchor or the direction of the boat.

Figure 5:
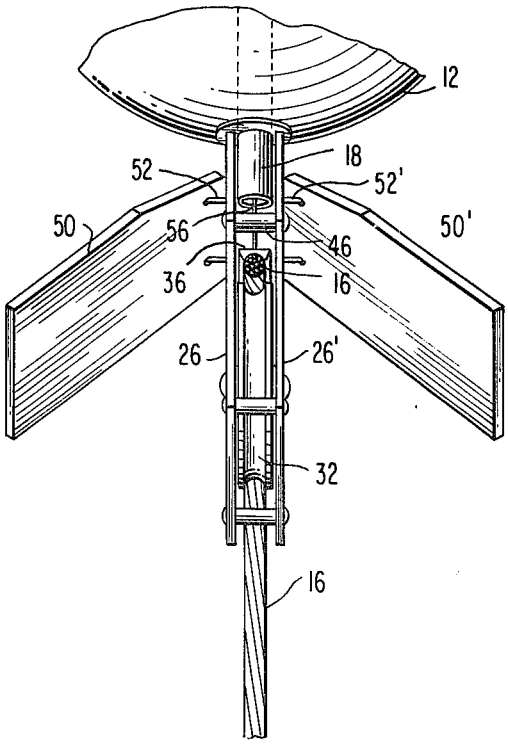
FIG. 5 is a fragmentary perspective view of the device of this invention showing the deflector plates extended during retrieval of an anchor.

With attention to FIGS. 4 and 5, while dogging mechanism normally depends from float 12, coaxially with tube 18, if the line is pulled in the direction of the boat, mechanism 14 will rotate toward the boat and toward the water surface. As the device 10 moves in the direction of the boat, pivotally mounted deflector plates 50 and 50' rotate outwardly to the position shown in FIG. 5 wherein said deflector plates are disposed at approximately 45° angles to plates 26 and 26' which house the mechanism and the pulley 32. The deflector plates 50 and 50' then dig into the water and prevent, along with the resistance of the float, displacement of the device 10. The result then is a vertical force exerted on the anchor as shown in FIG. 4 to disengage the anchor from the bottom.

In order to set an anchor, latching ring 58 will be disposed in slot 64, and the anchor and device of this invention will be pitched overboard. As the anchor falls to the bottom, the anchor line 16 will freely pass over pulley 32. When the anchor has been set and the slack pulled in, ring 58 will be set in slot 62 whereby pawl 36 will engage anchor line 16.

If it is desired to retrieve the anchor then, the boat is merely propelled at an angle to the anchor line whereupon deflector plates 50 and 50' will be pivoted outwardly as shown in FIG. 5 and a vertical force on the anchor will be exerted. In this way then, the anchor can be raised to the surface without dragging along the bottom. When the anchor reaches the surface, the operator will notice the boat is towing both the anchor and the anchor caddy of this invention.

If it is desired to move the boat to a different spot, the caddy may be towed to the spot, and latching ring 58 moved to slot 64. This will release the anchor line which will permit the anchor to fall to the bottom where it may be set in the conventional manner.

If it is desired to troll or cast with drift, a few feet of anchor line may be permitted to pass through the device of this invention whereupon ring 58 will be moved to slot 62 to permit pawl 36 to engage the line against further downward travel. The device with the anchor then functions as a sea anchor to slow the drift of the boat.

In summary then, the device of this invention will rapidly and efficiently assist in raising an anchor solely by movement of the boat. The device of this invention will effectively engage the anchor line in a dogging action which may be engaged or disengaged with one hand merely by rotating the latch ring 58 between slot 62 and/or slot 64. Furthermore, by providing a pulley for passage of the line, the line is less likely to foul and will pass freely through the device without snagging.

The device of this invention may be constructed of conventional plastic or metal materials. Preferably, the float member 12 is approximately 10 inches in diameter. The pulley member is preferably about 4 inches in diameter and approximately $\frac{3}{4}$ inch thick, $\frac{3}{8}$ inch or $\frac{1}{2}$ inch in diameter. Accordingly, a pulley $\frac{3}{4}$ inch thick will adequately accommodate the line. The pawl is preferably $\frac{1}{2}$ inch wide and $\frac{1}{8}$ inch thick, and the overall height of the dogging mechanism housing 14 is about 8 inches.

It will be obvious to those skilled in the art that the dimensions hereinabove described are illustrative and not intended to be limitative of the invention.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced herein.

It is claimed:

1. An anchor caddy device for mounting on a boat anchor line between the boat and the anchor, said device comprising:

a float having an upper and a lower portion, the upper portion normally riding out of the water when the float is disposed therein;

a housing mounted adjacent the lower portion of said float, said housing defining a passage therethrough for an anchor line;

releasable dogging means mounted in the passage through said housing for normally engaging an anchor line when the line extends therethrough to permit one way movement of the line, only, responsive to a force exerted thereon in the direction of the boat;

latch means mounted on the upper portion of said float and coupled to said dogging means for selectively releasing said means so that when an anchor line extends through the passage, two way movement of the line therethrough will be permitted;

deflector means carried by said housing and actuated by a force exerted thereon in the direction of the boat when an anchor line extends therethrough for restricting movement of said device responsive to said force.

2. The device of claim 1 wherein said housing comprises a pair of mutually spaced plates mounted at an end thereof depending from the lower portion of said float.

3. The device of claim 2 wherein said releasable dogging means comprises a pulley rotatably mounted between said housing plates; means pivotally mounted within said housing adjacent said pulley for releasably engaging an anchor line passing over said pulley; and spacer means disposed between said plates for defining with the upper circumferential surface of said pulley the passage for an anchor line through said housing.

4. The device of claim 3 wherein said means for releasably engaging an anchor line passing over said pulley includes an elongated pawl pivotally mounted between said plates and having a toothed end portion extending over the rotational axis of said pulley, and bias means connecting said pawl and said housing for normally bridging the toothed end portion thereof into said pulley whereby when an anchor line extends over said pulley the toothed portion of said pawl will engage the line against the pulley.

5. The device of claim 4 wherein said latch means further comprises a longitudinally movable latch mounted on the upper surface of said float and coupling means extending through said float and connecting said latch and said pawl whereby upward displacement of said latch will pivot the toothed end portion of said pawl away from said pulley.

6. The device of claim 5 wherein said coupling means comprises a tube extending substantially axially through said float, from said housing to said latch; and a cable extending through said tube having one end connected to said pawl and an opposite end connected to said latch.

7. The device of claim 6 wherein on the upper end of said tube there are two longitudinally directed slots, each slot having a different depth and said latch comprises a D-ring normally disposed in one of said slots.

8. The device of claim 6 wherein said housing is pivotally mounted to the lower end of said tube.

9. The device of claim 2 wherein said deflector means comprises a pair of flat wing members, each of said members pivotally mounted at an end thereof adjacent said float to one of said plates, said members adapted to pivot between a closed position wherein each of said member lies in a plane parallel to the plane containing the adjacent plate, to an open position wherein each of said members lies in a plane disposed at an acute angle to the plane containing the adjacent plate.

10. The device of claim 9 wherein the acute angle formed by the planes is about 45°.

* * * * *